US007780427B2

(12) United States Patent
Ueda et al.

(10) Patent No.: US 7,780,427 B2
(45) **Date of Patent: *Aug. 24, 2010**

(54) TWO-STAGE ROTARY COMPRESSOR

(75) Inventors: Kenshi Ueda, Kanagawa (JP); Naoya Morozumi, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/349,954

(22) Filed: Jan. 7, 2009

(65) Prior Publication Data

US 2009/0180907 A1 Jul. 16, 2009

(30) Foreign Application Priority Data

Jan. 10, 2008 (JP) ..... 2008-003266

(51) Int. Cl.
*F03C 2/00* (2006.01)
*F03C 4/00* (2006.01)
*F04C 11/00* (2006.01)
*F04C 2/00* (2006.01)

(52) U.S. Cl. ..... 418/11; 418/60; 418/249; 418/270; 418/DIG. 1

(58) Field of Classification Search ..... 418/11, 418/60, 63, 28, 31, 97, 249, 270, DIG. 1
See application file for complete search history.

(56) References Cited

U.S. PATENT DOCUMENTS 6,974,314 B2 * 12/2005 Matsumoto et al. ..... 418/60

FOREIGN PATENT DOCUMENTS

| | | |
|---|---|---|
| JP | 4-44492 | 4/1992 |
| JP | 09-079161 | 3/1997 |
| JP | 2004-027853 | 1/2004 |
| JP | 2006-152931 | 6/2006 |

OTHER PUBLICATIONS

Japanese Decision of a Patent Grant, w/ English translation thereof, issued in Japanese Patent Application No. JP 2008-003266 dated Jan. 26, 2010.

* cited by examiner

*Primary Examiner*—Theresa Trieu
(74) *Attorney, Agent, or Firm*—McDermott Will & Emery LLP

(57) ABSTRACT

A two-stage rotary compressor includes a sealed cylindrical compressor housing in which first, second, third communication holes are provided apart in an axial direction on an outer peripheral wall; an accumulator held at an outside part of the housing; a low-pressure connecting pipe for connecting a bottom communication hole of the accumulator and the second communication hole; and an intermediate connecting pipe for connecting the first and third communication holes. The first and third communication holes are provided nearly in the same locations in the circumferential direction of the housing. The accumulator is held nearly in the same location in the circumferential direction as that of the second communication hole. The second communication hole is provided in a different location in the circumferential direction from those of the first and third communication holes for preventing interference between the low-pressure and intermediate connecting pipes each formed in arc shape.

5 Claims, 12 Drawing Sheets

TWO-STAGE ROTARY COMPRESSOR

BACKGROUND OF THE INVENTION

1. Field of the Invention

The present invention relates to a two-stage rotary compressor (hereinafter, also simply referred to as "rotary compressor"), and specifically to a compressor with improved compression efficiency of refrigerant by reducing pressure loss of a low-pressure connecting pipe for connecting a compressor housing and an accumulator.

2. Description of the Related Art

Conventionally, a two-stage rotary compressor includes a low-stage compressing section and a high-stage compressing section and a motor for driving the low-stage compressing section and the high-stage compressing section inside of a cylindrical compressor housing that is a sealed container, and includes an accumulator outside of the compressor housing.

On an outer peripheral wall of the cylindrical compressor housing, a first communication hole, a second communication hole, and a third communication hole are provided apart from one another on a straight line along the center axis direction of the housing, and one end of a low-stage suction pipe for sucking in low-pressure gas refrigerant Ps within the accumulator is connected through the second communication hole to a suction hole of the low-stage compressing section.

Further, one end of a low-stage discharge pipe for discharging low-stage discharge gas refrigerant Pm to outside of the compressor housing is connected through the first communication hole to a low-stage muffler discharge hole of the low-stage compressing section, and one end of a high-stage suction pipe for sucking in the low-stage discharge gas refrigerant Pm is connected through the third communication hole to a suction hole of the high-stage compressing section. The other end of the low-stage suction pipe and the accumulator are connected by a low-pressure connecting pipe and the other end of the low-stage discharge pipe and the other end of the high-stage suction pipe are connected by an intermediate connecting pipe.

Through the pipe connection, a gas refrigerant flows in the following manner. The low-pressure gas refrigerant Ps is sucked in from the accumulator, passes through the low-pressure connecting pipe and the low-stage suction pipe, is taken in from the suction hole of the low-stage compressing section into the low-stage compressing section, and is compressed to intermediate pressure to be the low-stage discharge gas refrigerant Pm.

The low-stage discharge gas refrigerant Pm at the intermediate pressure discharged to the low-stage discharge space passes through the low-stage discharge pipe, the intermediate connecting pipe and the high-stage suction pipe, is sucked in from the suction hole of the high-stage compressing section into the high-stage compressing section, compressed to high pressure to be high-stage discharge gas refrigerant Pd, discharged into the inner space of the compressor housing, and passes through a clearance between motors and is discharged from the discharge pipe to a freezing cycle side (e.g., see Japanese Patent Application Laid-open No. 2006-152931).

However, according to the above described conventional technology, since the first communication hole, the second communication hole, and the third communication hole are provided on the straight line along the center axis direction of the outer peripheral wall of the compressor housing, in order to avoid the interference with the circular intermediate connecting pipe that connects the low-stage discharge pipe and the high-stage suction pipe, the low-pressure connecting pipe that connects the low-stage suction pipe and the accumulator has a complex shape formed by three-dimensional bending at right angles in two parts. Accordingly, there has been a problem that the pipe line resistance becomes greater and the pressure loss of the refrigerant becomes greater, and thus the compression efficiency of the rotary compressor becomes worse.

Further, since the distances between the respective communication holes of the compressor housing are short, there has been a problem that the pressure resistance of the compressor housing becomes lower, and the welding (brazing) operation between the low-pressure connecting pipe and the low-stage suction pipe and the welding (brazing) operation between the intermediate connecting pipe and the low-stage discharge pipe as well as the high-stage suction pipe are difficult.

SUMMARY OF THE INVENTION

It is an object of the present invention to at least partially solve the problems in the conventional technology.

According to an aspect of the present invention, a two-stage rotary compressor includes a sealed cylindrical compressor housing in which first, second, third communication holes are sequentially provided apart in an axial direction on an outer peripheral wall thereof; a low-stage compressing section provided within the compressor housing with one end of a low-stage suction pipe connected to a low-stage suction hole through the second communication hole and one end of a low-stage discharge pipe connected to a low-stage muffler discharge hole through the first communication hole; a high-stage compressing section provided near the low-stage compressing section within the compressor housing with one end of a high-stage suction pipe connected to a high-stage suction hole through the third communication hole and a high-stage muffler discharge hole communicating with inside of the compressor housing; a motor for driving the low-stage compressing section and the high-stage compressing section; a sealed cylindrical accumulator held at an outside part of the compressor housing; a low-pressure connecting pipe for connecting a bottom communication hole of the accumulator and the other end of the low-stage suction pipe; and an intermediate connecting pipe for connecting the other end of the low-stage discharge pipe and the other end of the high-stage suction pipe. The first, third communication holes are provided nearly in the same locations in the circumferential direction of the cylindrical compressor housing. The accumulator is held nearly in the same location in the circumferential direction as that of the second communication hole. The second communication hole is provided in a different location in the circumferential direction from those of the first communication hole and the third communication hole for preventing interference between the low-pressure connecting pipe and the intermediate connecting pipe each formed in a two-dimensional arc shape.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a rotary compressor according to the present invention will be described in detail below with reference to the drawings. The invention is not limited to the embodiments.

First Embodiment

Figure 1A:
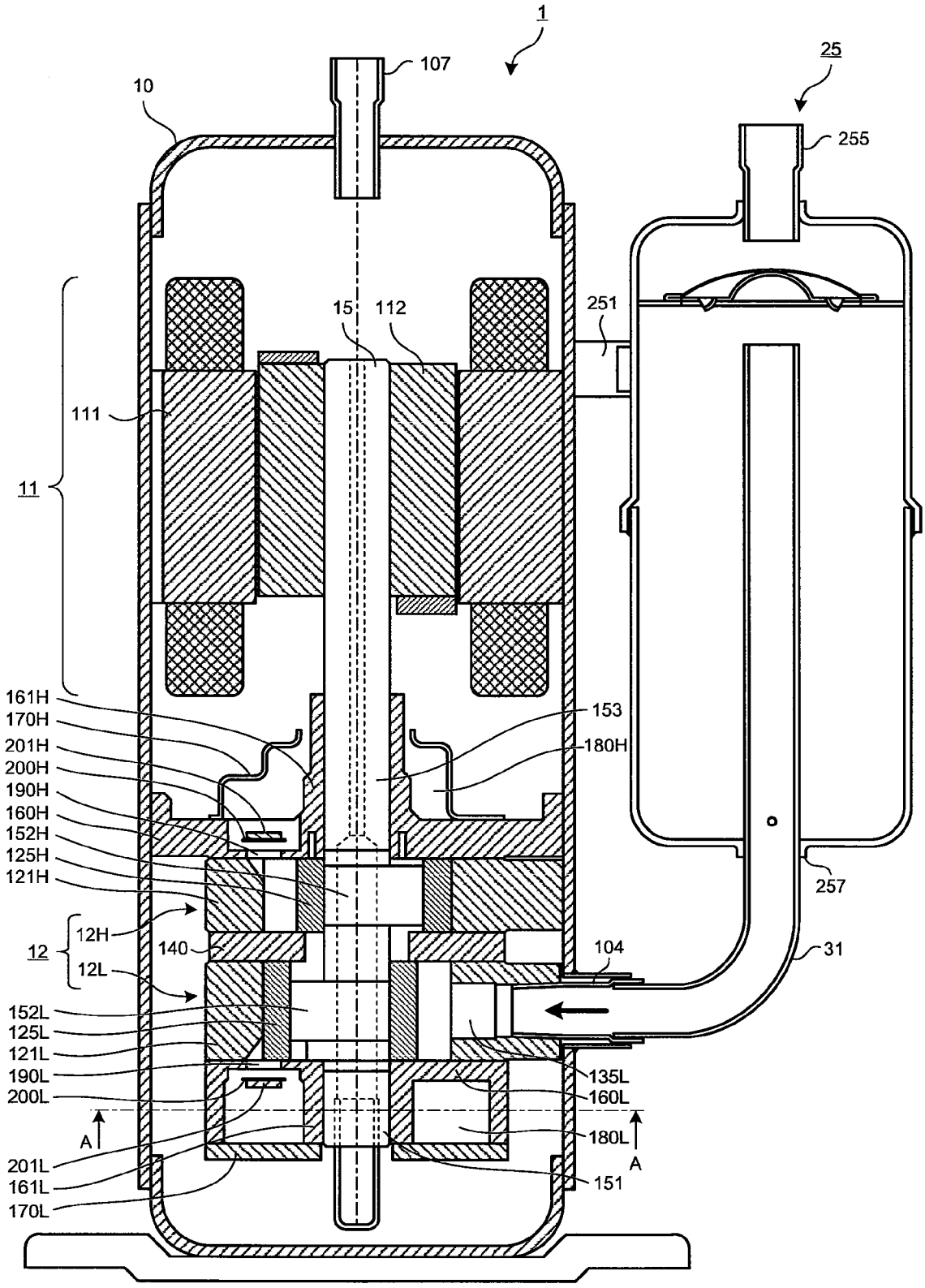
FIG. 1A is a longitudinal sectional view showing a first embodiment of a rotary compressor according to the invention.
Figure 1B:
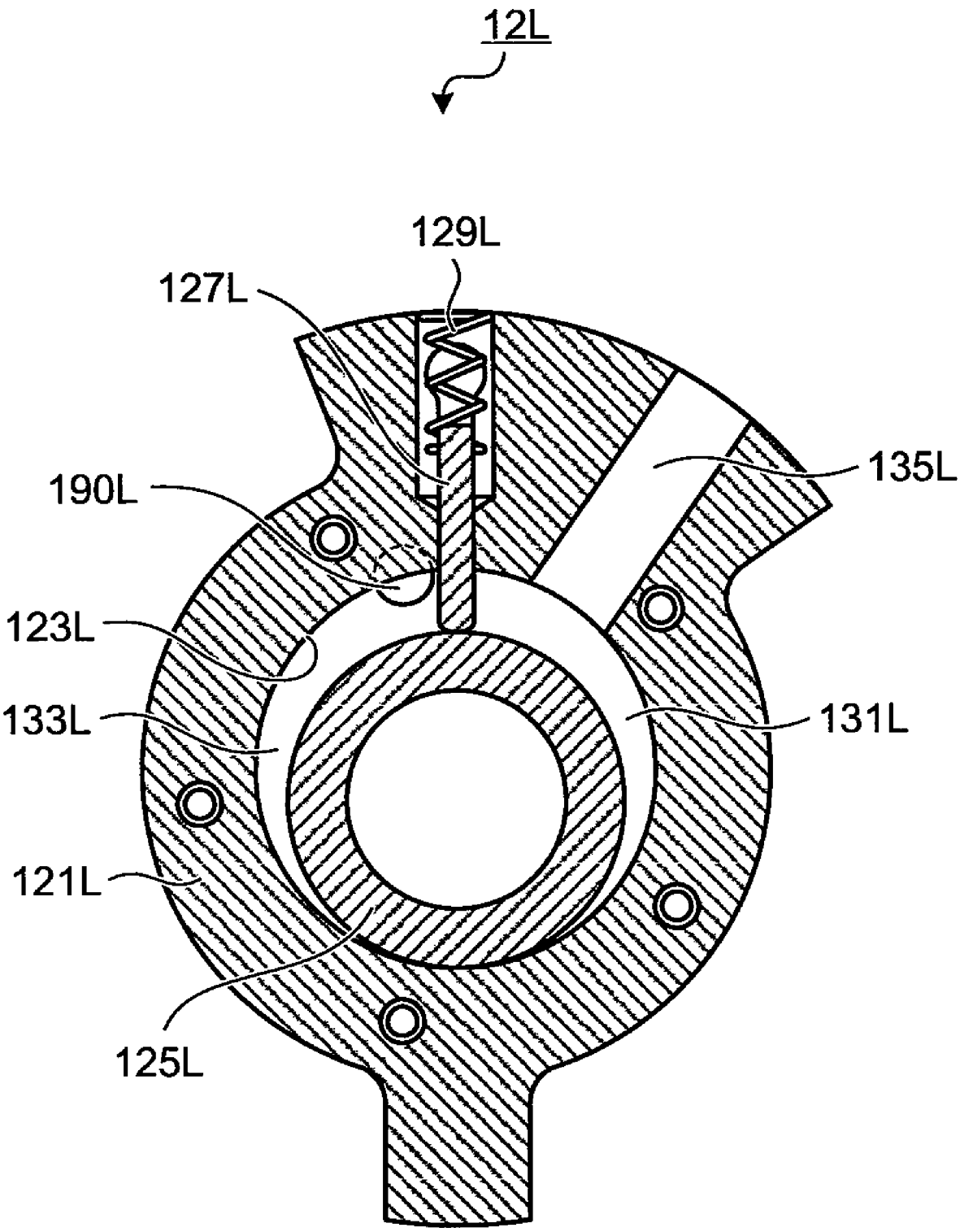
FIG. 1B is a cross sectional view of a low-stage compressing section.
Figure 1C:
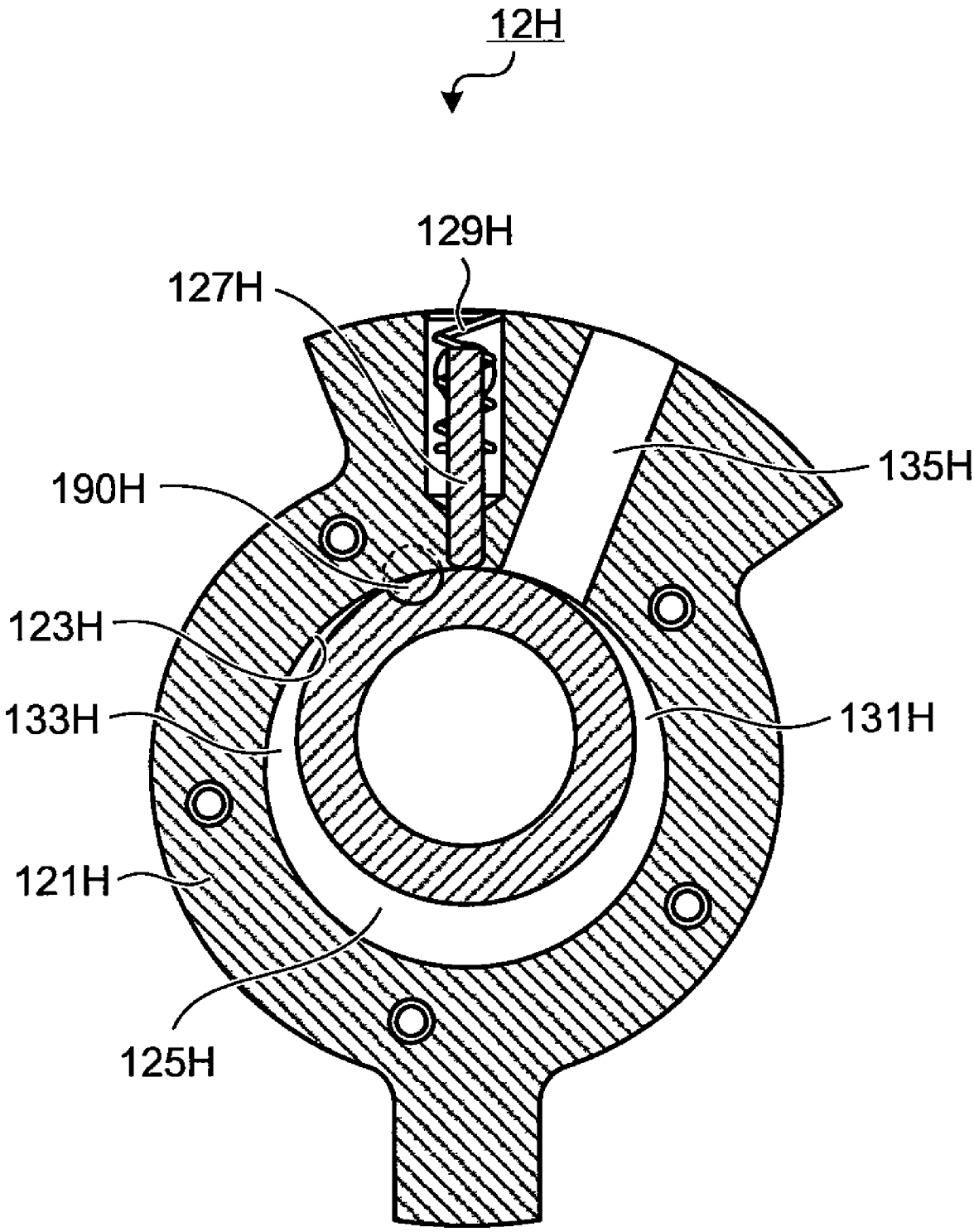
FIG. 1C is a cross sectional view of a high-stage compressing section.
Figure 1D:
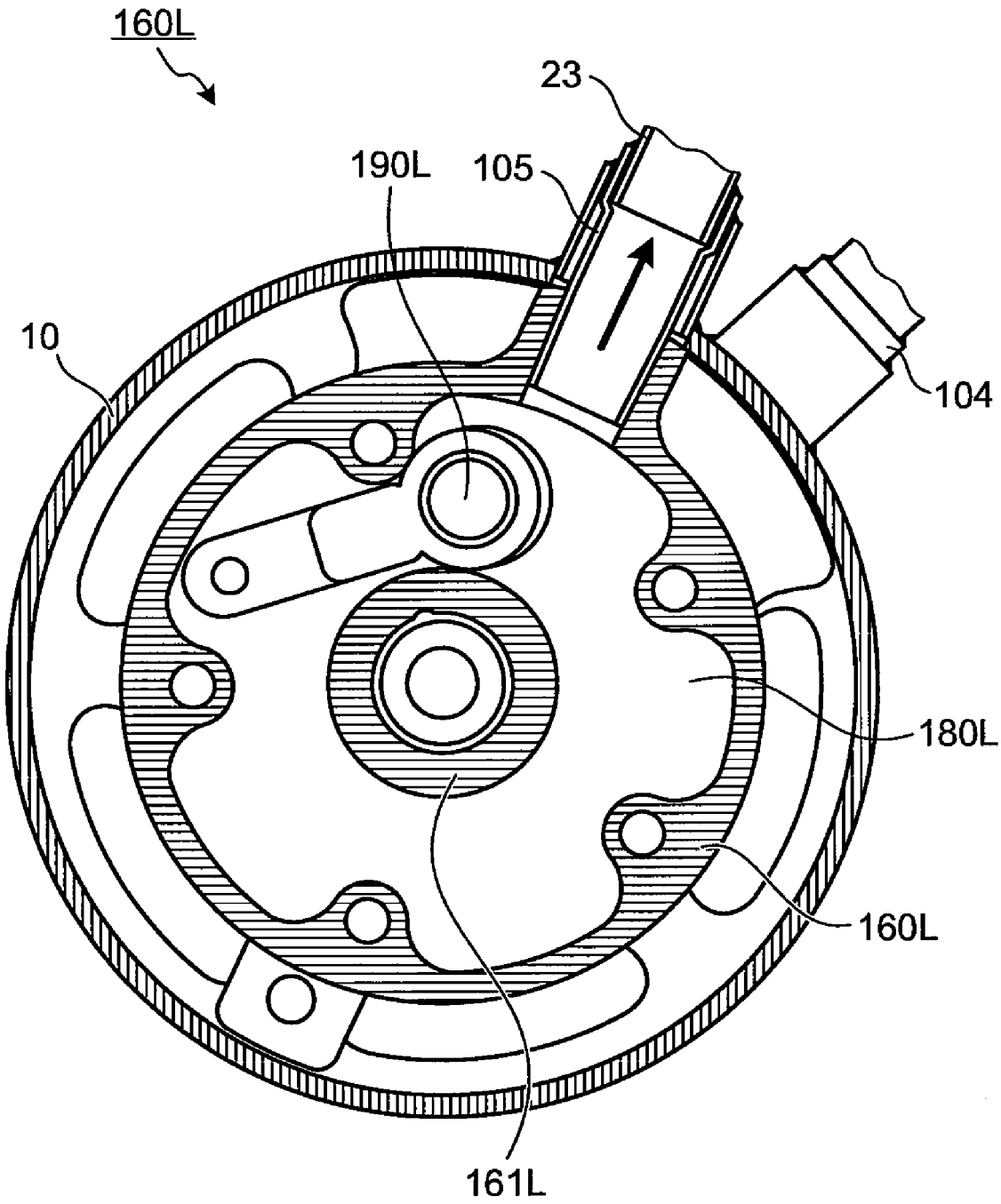
FIG. 1D is a cross sectional view along A-A line in FIG. 1A.
Figure 1E:
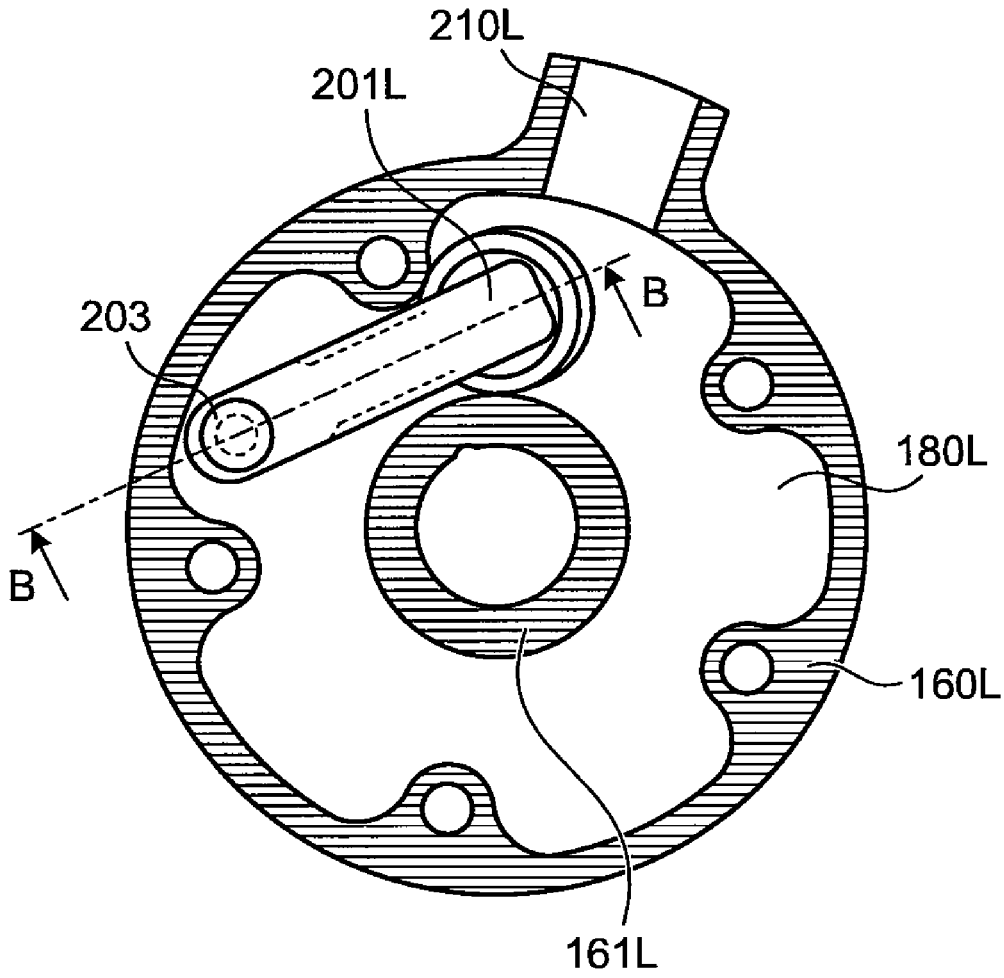
FIG. 1E is a cross sectional view of a low-stage end plate.
Figure 1F:
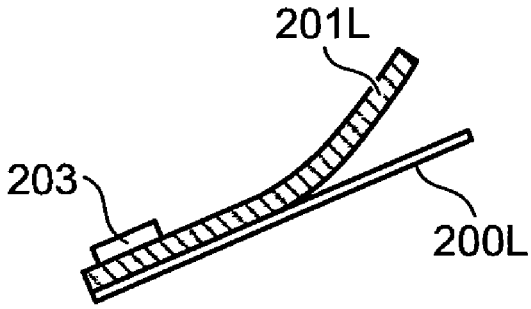
FIG. 1F is a sectional view along B-B line in FIG. 1E.
Figure 1G:
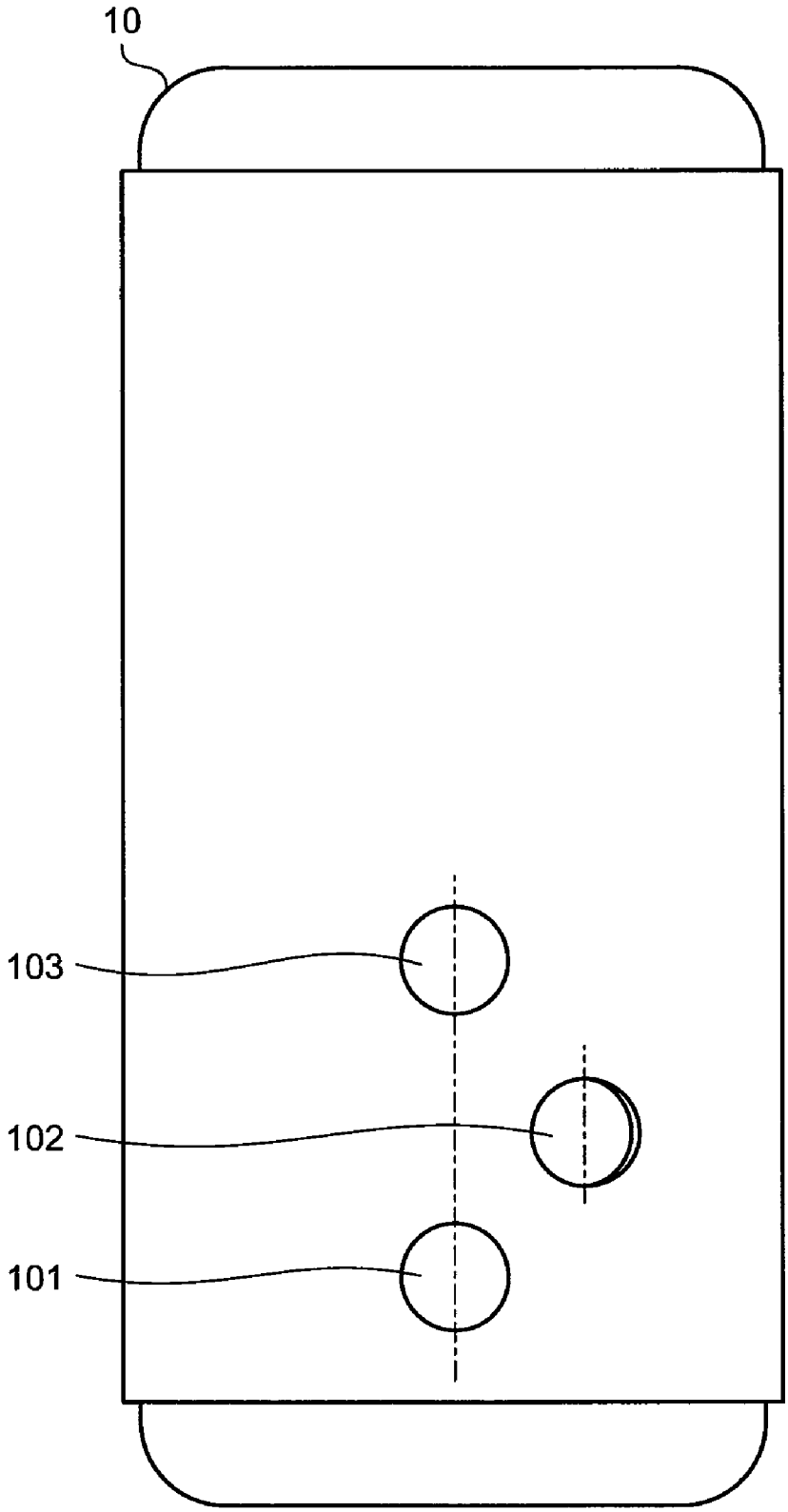
FIG. 1G is a front view of a compressor housing.
Figure 1H:
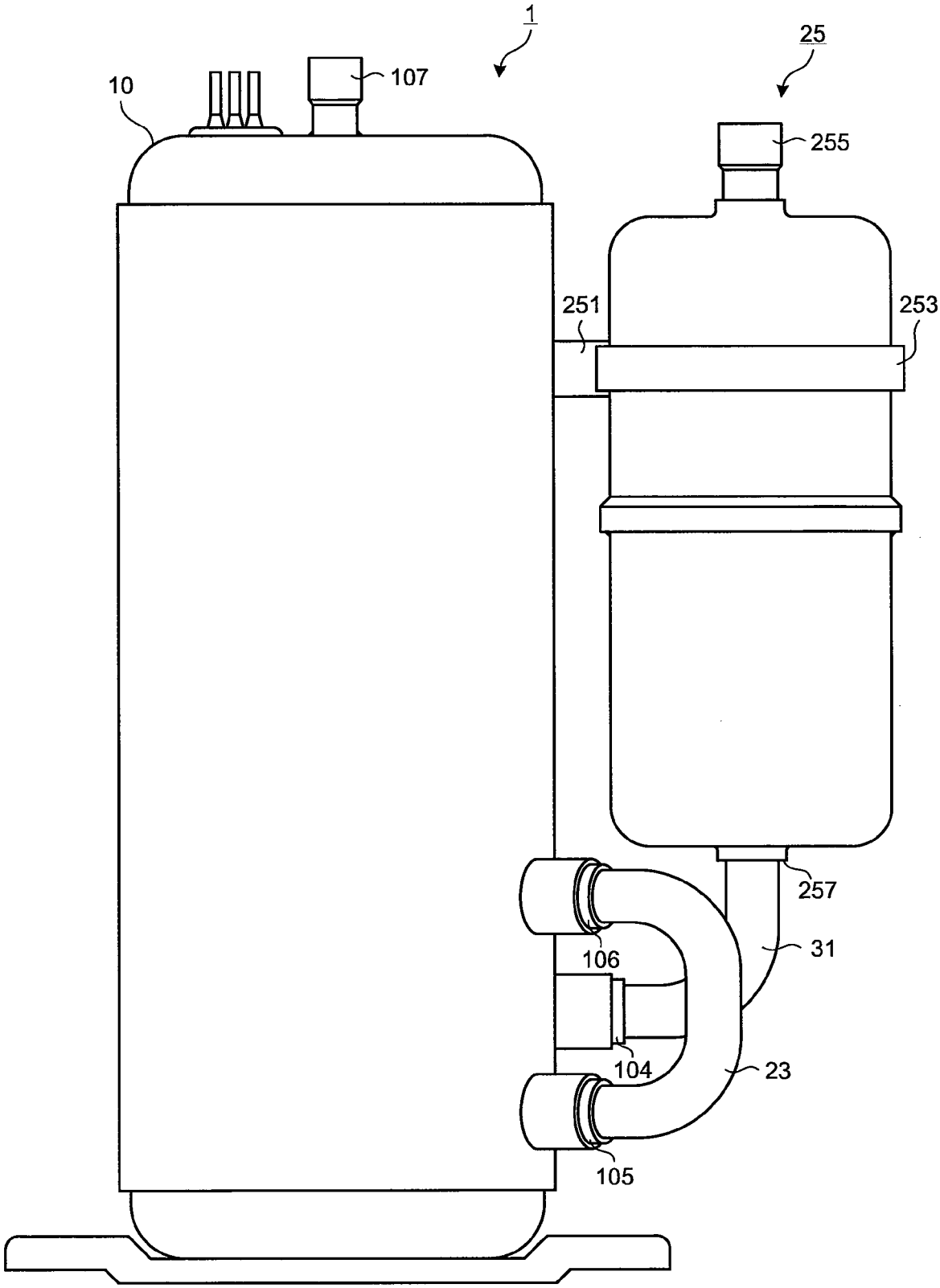
FIG. 1H is a side view of the rotary compressor of the first embodiment.

FIG. 1A is a longitudinal sectional view showing a first embodiment of the rotary compressor according to the invention, FIG. 1B is a cross sectional view of a low-stage compressing section, FIG. 1C is a cross sectional view 1of a high-stage compressing section, FIG. 1D is a cross sectional view along A-A line in FIG. 1A, FIG. 1E is a cross sectional view of a low-stage end plate, FIG. 1F is a sectional view along B-B line in FIG. 1E, FIG. 1G is a front view of a compressor housing, and FIG. 1H is a side view of the rotary compressor of the first embodiment.

As shown in FIG. 1A, a rotary compressor 1 of the first embodiment includes a compressing section 12 and a motor 11 for driving the compressing section 12 inside of the sealed cylindrical compressor housing 10.

A stator 111 of the motor 11 is fixed by thermal insert on an inner circumferential surface of the compressor housing 10. A rotor 112 of the motor 11 is located at the center of the stator 111 and fixed by thermal insert to a shaft 15 that mechanically connects the motor 11 and the compressing section 12.

The compressing section 12 includes a low-stage compressing section 12L, and a high-stage compressing section 12H connected in series with the low-stage compressing section 12L and provided above the low-stage compressing section 12L. As shown in FIGS. 1B and 1C, the low-stage compressing section 12L includes a low-stage cylinder 121L and the high-stage compressing section 12H includes a high-stage cylinder 121H.

In the low-stage cylinder 121L and the high-stage cylinder 121H, s low-stage cylinder bore 123L and a high-stage cylinder bore 123H are formed coaxially with the motor 11. Within the cylinder bores 123L and 123H, a cylindrical low-stage piston 125L and a cylindrical high-stage piston 125H each having smaller diameters than the bore diameter are provided, and compression spaces for compressing a refrigerant are formed between the respective cylinder bores 123L and 123H and pistons 125L and 125H.

On the cylinders 121L and 121H, grooves over the entire areas at the heights of the cylinders are formed in the radial direction from the cylinder bores 123L and 123H, and a low-stage vane 127L and a high-stage vane 127H, which are plate shaped, are fitted into the grooves. To the compressor housing 10 side of the vanes 127L and 127H, a low-stage spring 129L and a high-stage spring 129H are attached.

By the repulsion force of the springs 129L and 129H, the leading ends of the vanes 127L and 127H are pressed against the outer peripheral surfaces of the pistons 125L and 125H, and, by the vanes 127L and 127H, the compression spaces are partitioned into a low-stage suction chamber 131L and a high-stage suction chamber 131H and a low-stage compression chamber 133L and a high-stage compression chamber 133H.

On the cylinders 121L and 121H, in order to suck in the refrigerant into the suction chambers 131L and 131H, a low-stage suction hole 135L and a high-stage suction hole 135H that communicate with the suction chambers 131L and 131H are provided, and the low-stage suction hole 135L of the low-stage cylinder 121L is provided facing in the circumferential direction different from that in which the high-stage suction hole 135 of the high-stage cylinder 121H and a low-stage muffler discharge hole 210L, which will be described later, face.

Further, an intermediate partition plate 140 is provided between the low-stage cylinder 121L and the high-stage cylinder 121H, and partitions the compression space of the low-stage cylinder 121L and the compression space of the high-stage cylinder 121H. A low-stage end plate 160L is provided below the low-stage cylinder 121L and blocks the lower part of the compression space of the low-stage cylinder 121L. Further, a high-stage end plate 160H is provided above the high-stage cylinder 121H and blocks the upper part of the compression space of the low-stage cylinder 121H.

A lower bearing 161L is formed on the low-stage end plate 160L, and a lower part 151 of the shaft 15 is rotatably supported by the lower bearing 161L. Further, an upper bearing 161H is formed on the high-stage end plate 160H, and an intermediate part 153 of the shaft 15 is fitted in the upper bearing 161H.

The shaft 15 includes a low-stage crank part 152L and a high-stage crank part 152H eccentric 180° in phase from each other, and the low-stage crank part 152L rotatably holds the low-stage piston 125L of the low-stage compressing section 12L and the high-stage crank part 152H rotatably holds the high-stage piston 125H of the high-stage compressing section 12H.

When the shaft 15 rotates, the pistons 125L and 125H make gyratory motions while rolling on the inner circumferential walls of the cylinder bores 123L and 123H, and accordingly, the vanes 127L and 127H make reciprocal motions. Because of the motions of the pistons 125L and 125H and vanes 127L and 127H, volumes of the low-stage suction chamber 131L, the high-stage suction chamber 131H, the low-stage compression chamber 133L, and the high-stage compression chamber 133H continuously change, and the compressing section 12 continuously sucks in, compresses, and discharges the refrigerant.

A low-stage muffler cover 170L is provided under the low-stage end plate 160L and forms a low-stage muffler chamber 180L between the low-stage end plate 160L and itself. Further, the discharge part of the low-stage compressing section 12L is open to the low-stage muffler chamber 180L. Accordingly, a low-stage discharge hole 190L for communicating the compression space of the low-stage cylinder 121L and the low-stage muffler chamber 180L is provided on the low-stage end plate 160L, and a low-stage discharge valve 200L for preventing the backward flow of the compressed refrigerant is provided in the low-stage discharge hole 190L.

As shown in FIGS. 1D and 1E, the low-stage muffler chamber 180L is one chamber that is circularly communicated and a part of the intermediate communication path that communicates the discharge side of the low-stage compressing section 12L and the suction side of the high-stage compressing section 12H.

Further, as shown in FIGS. 1E and 1F, on the low-stage discharge valve 200L, a low-stage discharge valve presser 201L for restricting the amount of deflection opening of the low-stage discharge valve 200L is fastened with a rivet 203 together with the low-stage discharge valve 200L. Furthermore, the low-stage muffler discharge hole 210L for discharging the refrigerant within the low-stage muffler chamber 180L is provided on the outer peripheral wall of the low-stage end plate 160L. The low-stage muffler discharge hole 210L and the low-stage suction hole 135L are provided to face in the same circumferential direction.

A high-stage muffler cover 170H is provided above the high-stage end plate 160H and forms a high-stage muffler chamber 180H between the high-stage end plate 160H and itself. A high-stage discharge hole 190H for communicating the compression space of the high-stage cylinder 121H and the high-stage muffler chamber 180H is provided on the high-stage end plate 160H, and a high-stage discharge valve 200H for preventing the backward flow of the compressed refrigerant is provided in the high-stage discharge hole 190H. Further, on the high-stage discharge valve 200H, a high-stage discharge valve presser 201H for restricting the amount of deflection opening of the high-stage discharge valve 200H is fastened with a rivet together with the high-stage discharge valve 200H.

The low-stage cylinder 121L, the low-stage end plate 160L, the low-stage muffler cover 170L, the high-stage cylinder 121H, the high-stage end plate 160H, the high-stage muffler cover 170H, and the intermediate partition plate 140 are integrally fastened with a bolt (not shown). Of the integrally fastened compressing section 12, the outer peripheral part of the high-stage end plate 160H is bonded and fixed by spot welding to the compressor housing 10, and thereby, the compressing section 12 is fixed to the compressor housing 10.

As shown in FIG. 1G, on the outer peripheral part of the cylindrical compressor housing 10, a first communication hole 101, a second communication hole 102, and a third communication hole 103 are provided apart in the axis direction in this order from the lower part. The first communication hole 101 and the third communication hole 103 are provided nearly in the same locations in the circumferential direction of the compressor housing 10, and the second communication hole 102 is provided in a different location in the circumferential direction from those of the first communication hole 101 and the third communication hole 103 for preventing interference between a low-pressure connecting pipe 31 and an intermediate connecting pipe 23, which will be described later.

As shown in FIGS. 1A and 1H, in front of the outside part of the compressor housing 10 nearly in the same location in the circumferential direction as that of the second communication hole 102, an accumulator 25 including an independent cylindrical sealed container is held by an accumulator holder 251 and an accumulator band 253. At the center of the top of the accumulator 25, a system connecting pipe 255 for connecting to the freezing cycle side is connected, and the low-pressure connecting pipe 31 with one end extended to the upper part inside of the accumulator 25 and the other end connected to the other end of a low-stage suction pipe 104 is connected to a bottom communication hole 257 provided at the center of the bottom part of the accumulator 25.

The low-pressure connecting pipe 31 that guides the low-pressure refrigerant for the freezing cycle to the low-stage compressing section 12L via the accumulator 25 is connected to the low-stage suction hole 135L of the low-stage cylinder 121L via the second communication hole 102 and the low-stage suction pipe 104. The part of low-pressure connecting pipe 31 between the low-stage suction pipe 104 and the bottom communication hole 257 of the accumulator 25 is formed by two-dimensional bending into a shape like a quarter of a circle.

One end of a low-stage discharge pipe 105 is connected through the first communication hole 101 to the low-stage muffler discharge hole 210L of the low-stage muffler chamber 180L, one end of a high-stage suction pipe 106 is connected through the third communication hole 103 to the high-stage suction hole 135H of the high-stage cylinder 121H, and the other end of the low-stage discharge pipe 105 and the other end of the high-stage suction pipe 106 are connected by the intermediate connecting pipe 23 formed by two-dimensional bending into a shape like a half of a circle. The second communication hole 102 is provided in a different location in the circumferential direction from those of the first communication hole 101 and the third communication hole 103 for preventing interference between the low-pressure connecting pipe 31 and the intermediate connecting pipe 23.

The discharge part of the high-stage compressing section 12H communicates with the inside of the compressor housing 10 via the high-stage muffler chamber 180H. Accordingly, the high-stage discharge hole 190H for communicating the compression space of the high-stage cylinder 121H and the high-stage muffler chamber 180H is provided on the high-stage end plate 160H, and the high-stage discharge valve 200H for preventing the backward flow of the compressed refrigerant is provided in the high-stage discharge hole 190H. The discharge part of the high-stage muffler chamber 180H communicates with inside of the compressor housing 10. A discharge pipe 107 for discharging the high-pressure refrigerant to the freezing cycle side is connected to the top of the compressor housing 10.

Inside of the compressor housing 10, lubricant oil is sealed nearly up to the height of the high-stage cylinder 121H, and the lubricant oil circulates in the compressing section 12 with a vane pump (not shown) inserted into the lower part of the shaft 15 and seals the part that partitions the compression space of the compression refrigerant with lubrication of sliding members and micro spaces.

As described above, in the rotary compressor 1 of the first embodiment, the first communication hole 101 and the third communication hole 103 of the compressor housing 10 are provided nearly in the same locations in the circumferential direction of the compressor housing 10, and the second communication hole 102 is provided in a different location in the circumferential direction from those of the first communication hole 101 and the third communication hole 103 for preventing interference between the low-pressure connecting pipe 31 and the intermediate connecting pipe 23.

Thus, the bent part of the low-pressure connecting pipe 31 is only one part and can be formed by two-dimensional bending into a shape like an arc, and machining of the low-pressure connecting pipe 31 becomes easier and the cost can be reduced. Further, the pipe line resistance of the low-pressure connecting pipe 31 can be reduced, the suction pressure loss can be reduced, and the compression efficiency of the rotary compressor 1 can be improved.

Furthermore, the distance between the first communication hole 101 and the second communication hole 102 and the distance of the second communication hole 102 and the third communication hole 103 of the compressor housing 10 can be increased and the pressure resistance of the parts between the communication holes of the compressor housing 10 can be improved, and the welding (brazing) operation between the low-pressure connecting pipe 31 and the intermediate connecting pipe 23 is facilitated.

Second Embodiment

Figure 2A:
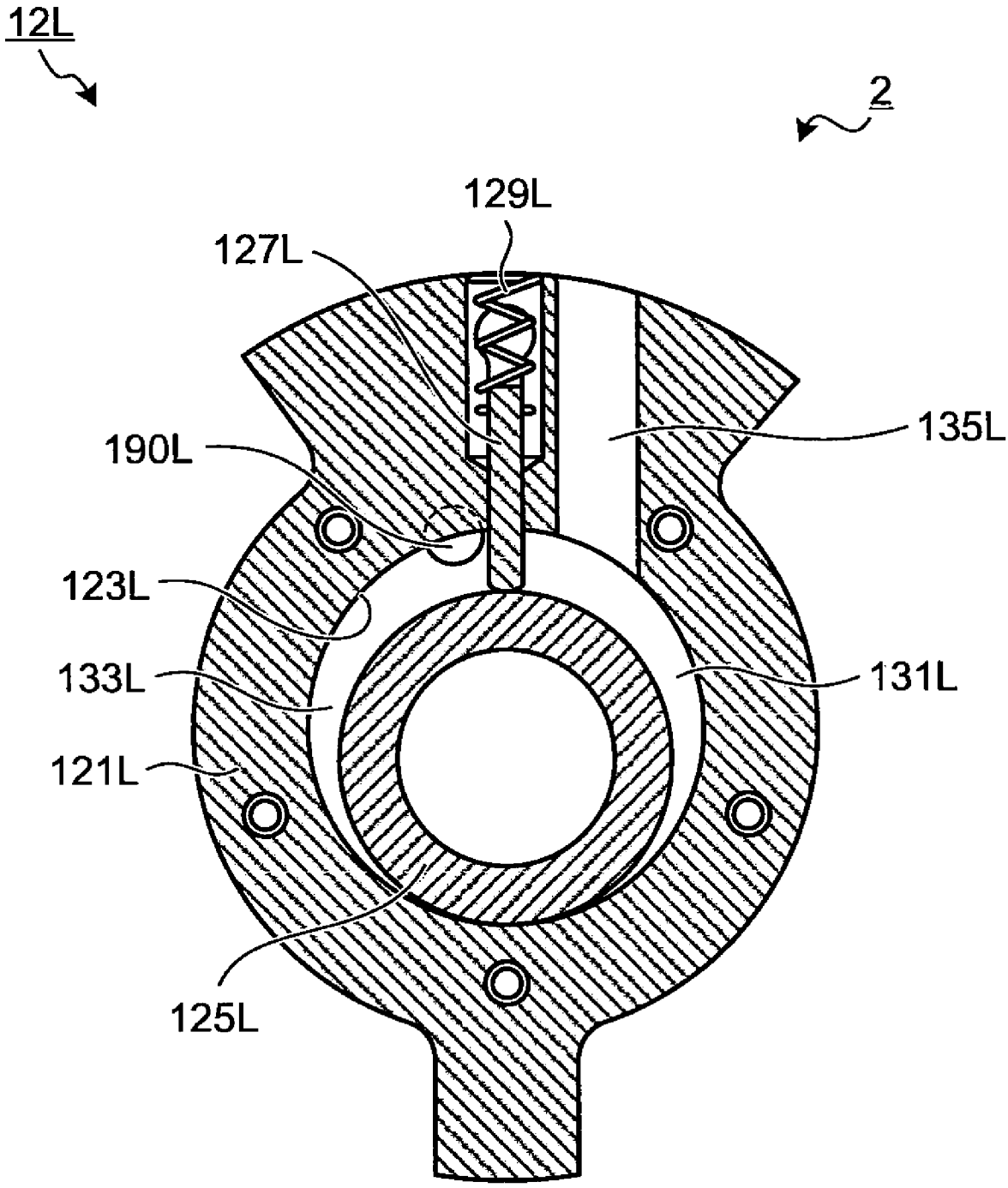
FIG. 2A is a cross sectional view of a low-stage compressing section showing a second embodiment of a rotary compressor according to the invention.
Figure 2B:
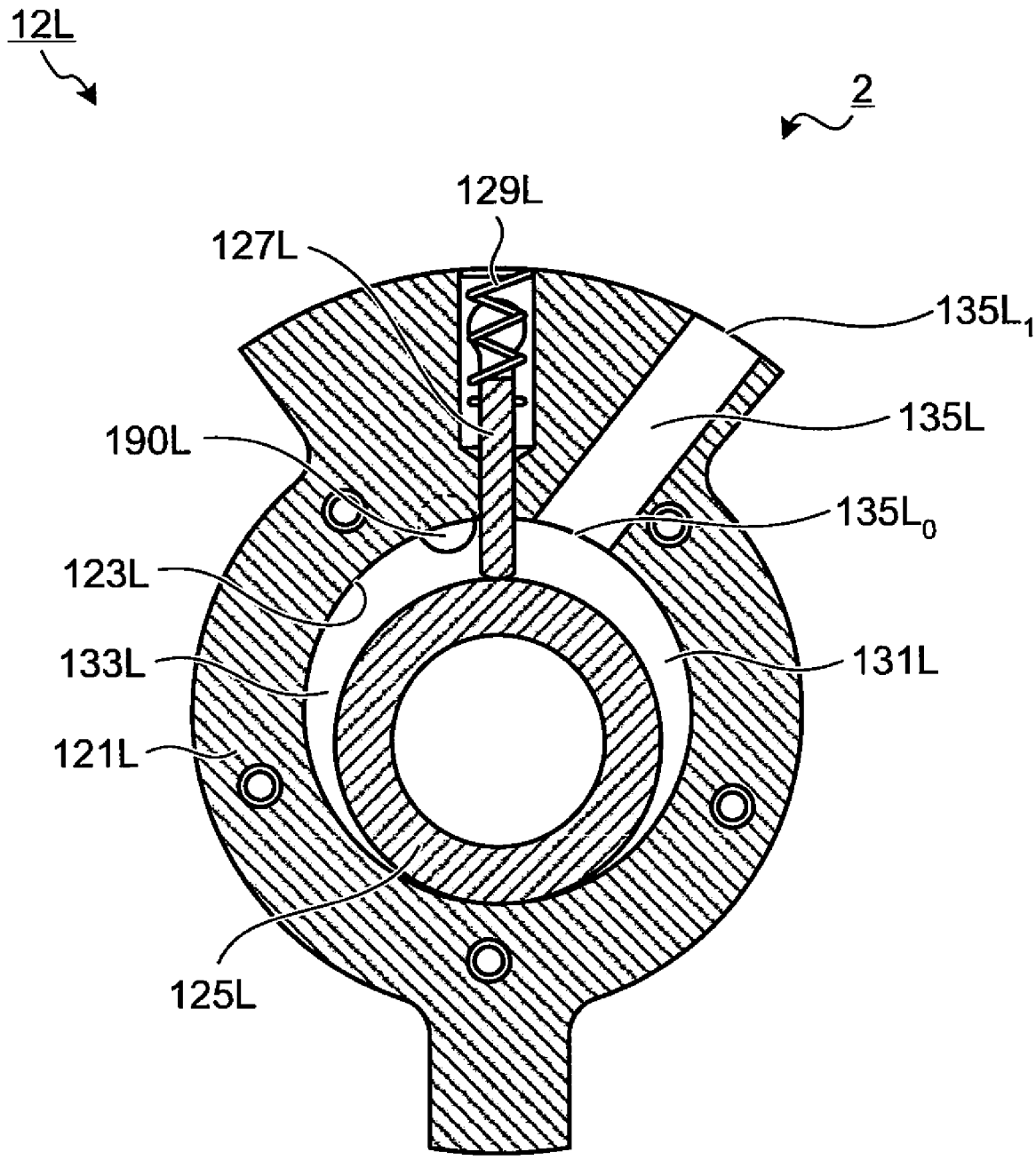
FIG. 2B is a cross sectional view of another example of the low-stage compressing section.

FIG. 2A is a cross sectional view of a low-stage compressing section showing a second embodiment of a rotary compressor according to the invention, and FIG. 2B is a cross sectional view of another example of the low-stage compressing section. A rotary compressor 2 of the second embodiment is different from the rotary compressor of the first embodiment only in the location of the low-stage suction hole of the low-stage compressing section, and the different part will be described and the description of the other part will be omitted.

As shown in FIGS. 1B, 1C, 1D, and 1E, the low-stage suction hole 135L of the low-stage cylinder 121L is formed radially from the center axial line to face in the circumferential direction different from that in which the high-stage suction hole 135H of the high-stage cylinder 121H and a low-stage muffler discharge hole 210L face in the first embodiment. On the other hand, in the second embodiment as shown in FIG. 2A, the low-stage suction hole 135L of the low-stage cylinder 121L is not formed radially from the center axial line but provided in parallel close to the low-stage vane 127L.

Since the low-stage suction hole 135L of the low-stage cylinder 121L is provided in parallel close to the low-stage vane 127L, the low-pressure connecting pipe 31 and the intermediate connecting pipe 23 can be piped in the same manner as that of the first embodiment without change of the bolt hole position of the bolt for securing the entire compressing section 12.

Further, in the other example of the second embodiment shown in FIG. 2B, regarding the low-stage suction hole 135L, a suction hole outlet 135Lo is provided nearly in the same location in the circumferential direction as that of a suction hole outlet of the high-stage suction hole 135H, and a suction hole inlet 135Li is provided in a different location in the circumferential direction from that of a suction hole inlet of the high-stage suction hole 135H. In this way, the low-pressure connecting pipe 31 and the intermediate connecting pipe 23 can be piped in the same manner as that of the first embodiment.

Third Embodiment

Figure 3:
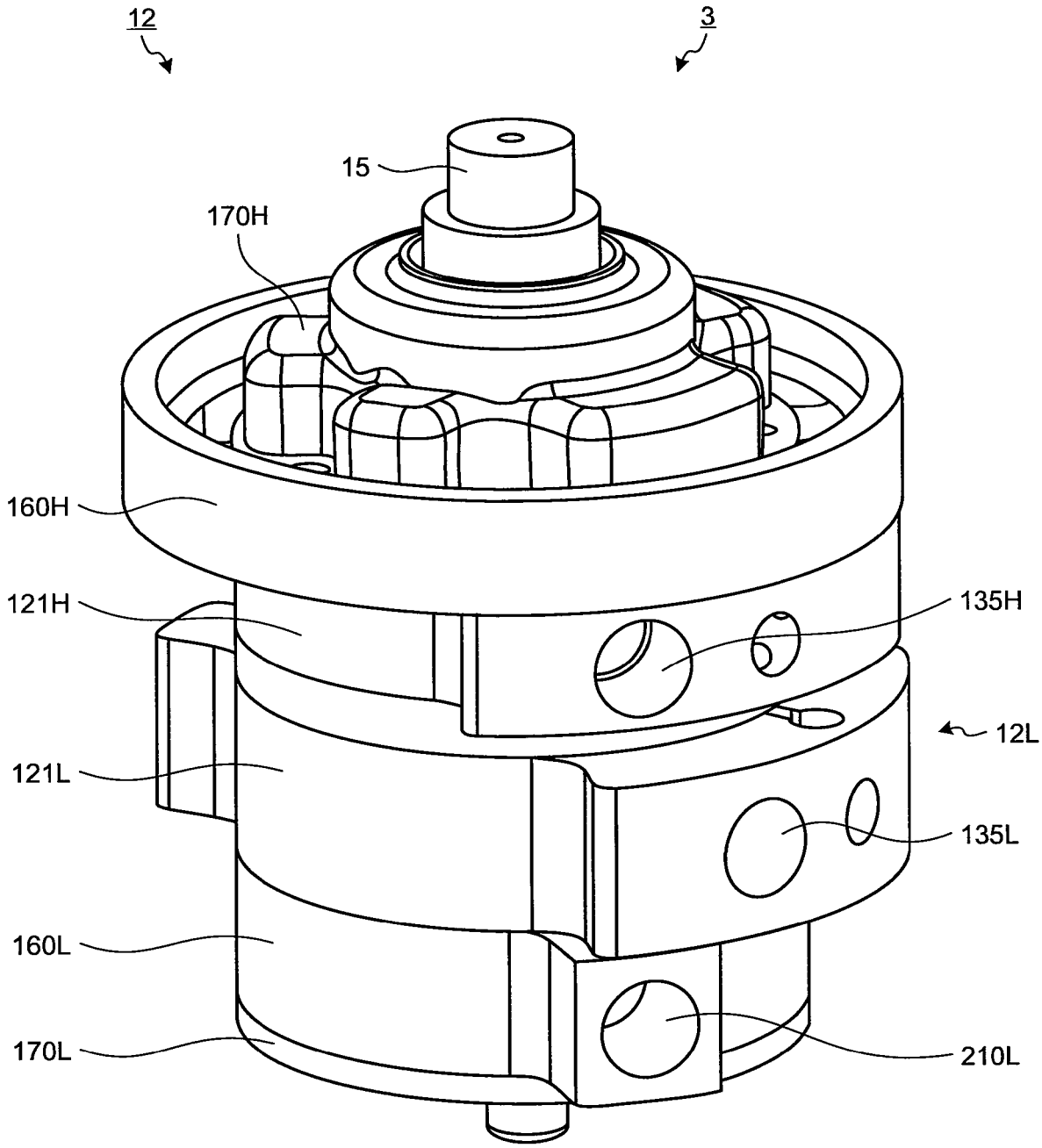
FIG. 3 is a perspective view of a compressing section showing a third embodiment of a rotary compressor according to the invention.

FIG. 3 is a perspective view of the compressing section showing a third embodiment of a rotary compressor according to the invention. A rotary compressor 3 of the third embodiment is different from the rotary compressor 1 of the first embodiment only in the location of the low-stage compressing section in the circumferential direction, and the different part will be described and the description of the other part will be omitted.

In the rotary compressors 1, 2 of the first and second embodiments, the low-stage suction hole 135L of the low-stage cylinder 121L is provided in the circumferential direction different from that of the high-stage suction hole 135H of the high-stage cylinder 121H; however, in the rotary compressor 3 of the third embodiment, as shown in FIG. 3, the high-stage suction hole 135H of the high-stage cylinder 121H and the low-stage muffler discharge hole 210L of the low-stage end plate 160L are provided to face nearly in the same circumferential direction, and the low-stage cylinder 121L is provided to shift to a predetermined angle in the circumferential direction.

According to the rotary compressor 3 of the third embodiment, the low-pressure connecting pipe 31 and the intermediate connecting pipe 23 can be piped in the same manner as that of the first embodiment only by changing the eccentric angle position of the low-stage eccentric part 152L of the shaft 15 without changing the position in which the low-stage suction hole 135L of the low-stage cylinder 121L is formed.

Fourth Embodiment

Figure 4A:
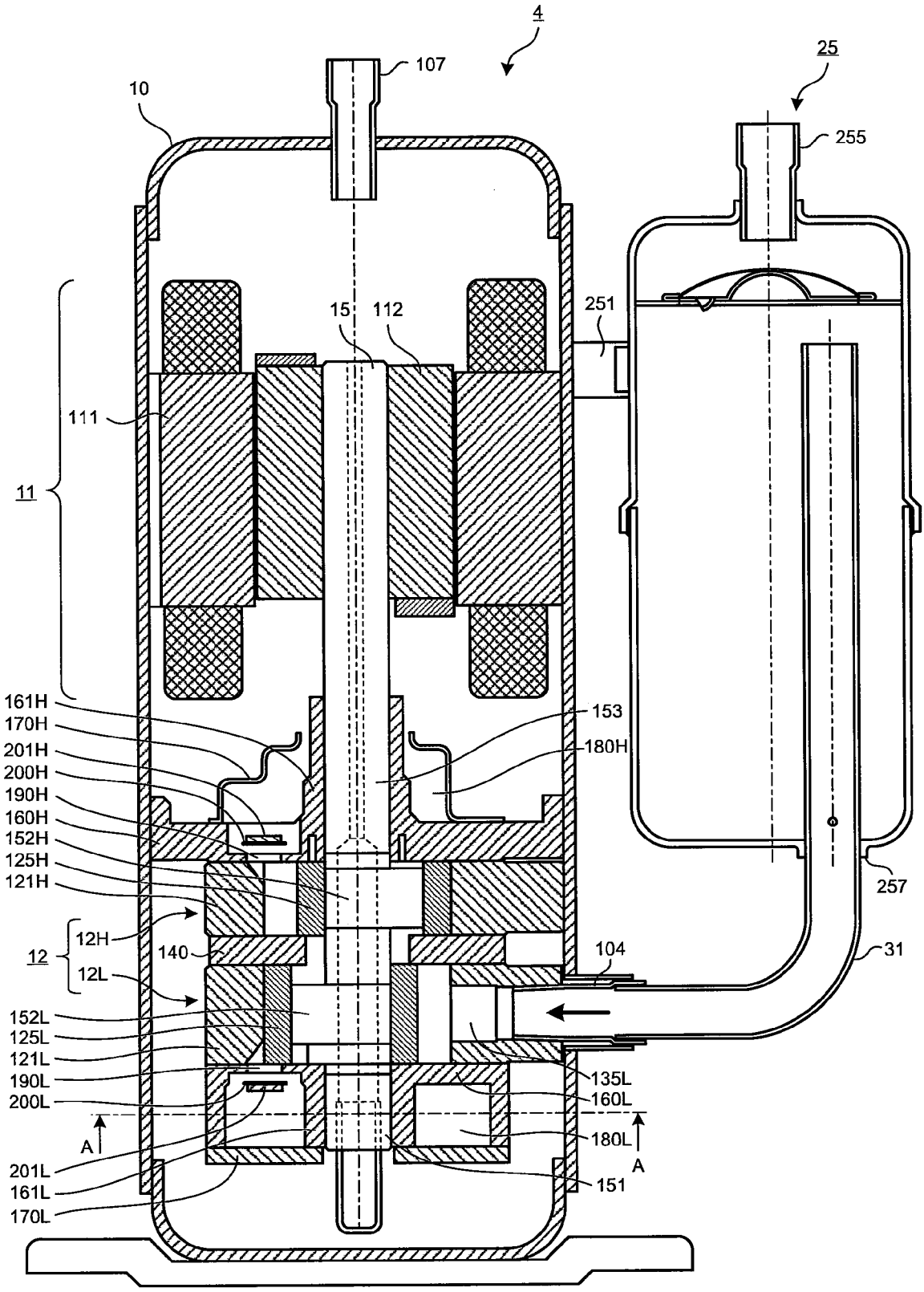
FIG. 4A is a longitudinal sectional view showing a fourth embodiment of a rotary compressor according to the invention.
Figure 4B:
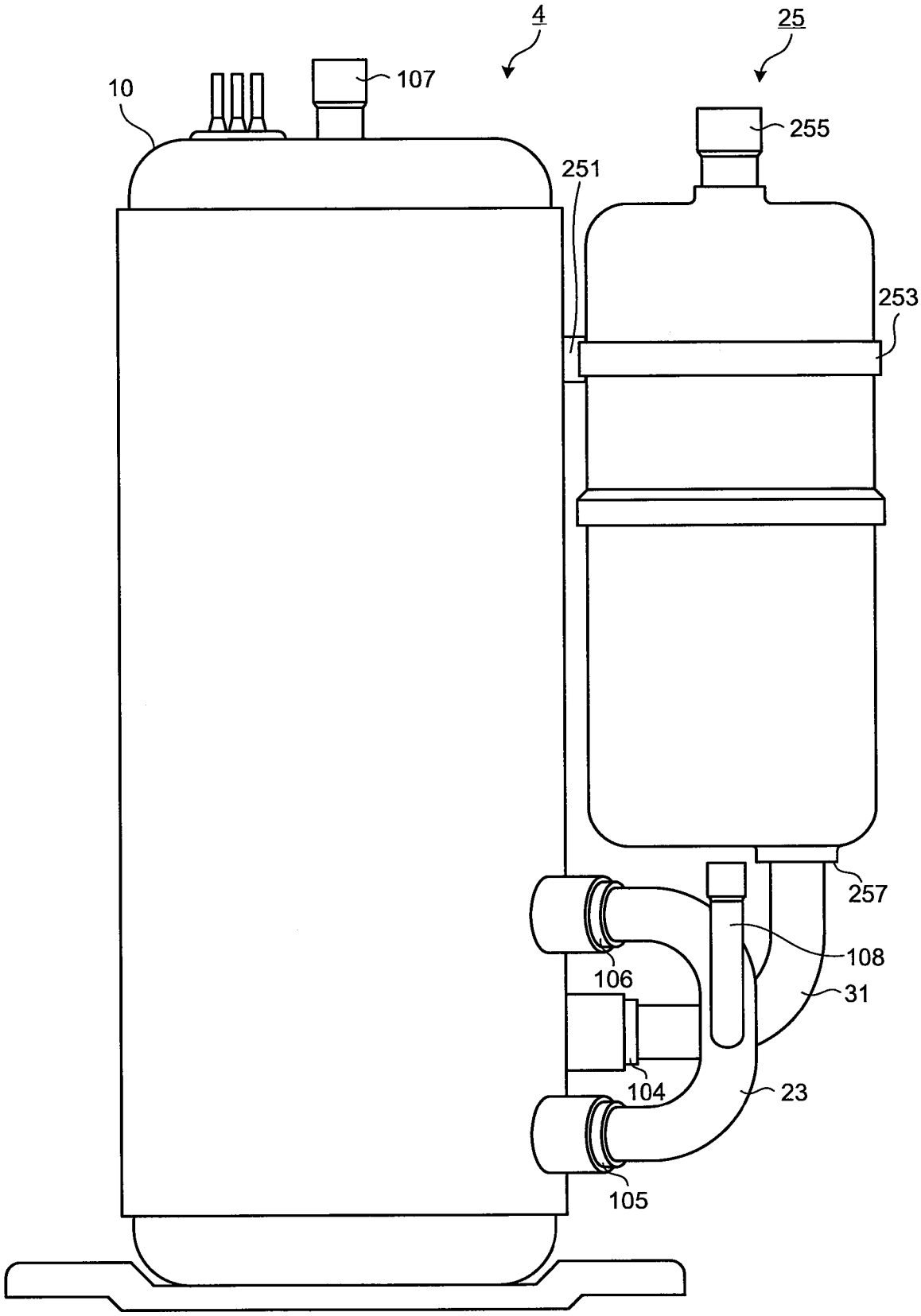
FIG. 4B is a side view of the rotary compressor of the fourth embodiment.

FIG. 4A is a longitudinal sectional view showing a fourth embodiment of a rotary compressor according to the invention, and FIG. 4B is a side view of the rotary compressor of the fourth embodiment. As shown in FIG. 1A, in the rotary compressor 1 of the first embodiment, the low-pressure connecting pipe 31 connecting the low-stage compressing section 12L and the accumulator 25 is connected to the bottom communication hole 257 provided in the position of the center axis of the accumulator 25. On the other hand, as shown in FIG. 4A, in the rotary compressor 4 of the fourth embodiment, the bottom communication hole 257 is provided in the position apart from the compressor housing 10 than the position of the center axis of the accumulator 25.

Thus, the accumulator 25 can be provided near the compressor housing 10, and a rotary compressor assembly including the accumulator 25 can be made compact.

As shown in FIG. 4B, in the rotary compressor 4 of the fourth embodiment, a gas injection cycle is used as the freezing cycle, and an injection pipe 108 is connected to the intermediate connecting pipe 23 for connecting the discharge side of the low-stage compressing section 12L and the suction side of the high-stage compressing section 12H so that an injection refrigerant may be flown into it.

Further, the rotary compressor 4 of the fourth embodiment including the motor 11 may be adapted to variable rotational speed. At high speed rotation, i.e., when the flow amount of circulating refrigerant is large, the pressure loss in the low-pressure connecting pipe 31 becomes greater. Therefore, reducing the pipe line resistance of the low-pressure connecting pipe 31 improves the efficiency more effectively.

In the rotary compressors 1, 2, 3, and 4 of the first to fourth embodiments in the compressing section 12, the high-stage compressing section 12H is provided above the low-stage compressing section 12L; however, the low-stage compressing section 12L may be provided above the high-stage compressing section 12H.

As described above, the two-stage rotary compressor according to the invention is useful for use at high speed rotation.

The rotary compressor according to an embodiment of the present invention has advantages that the pressure efficiency is improved and the pressure resistance of the compressor housing is improved by reducing the pipe line resistance of the low-pressure connecting pipe, and the welding (brazing) operation of the low-pressure connecting pipe and the intermediate connecting pipe is facilitated.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A two-stage rotary compressor comprising:

a sealed cylindrical compressor housing in which first, second, third communication holes are sequentially provided apart in an axial direction on an outer peripheral wall thereof;

a low-stage compressing section provided within the compressor housing with one end of a low-stage suction pipe connected to a low-stage suction hole through the second communication hole and one end of a low-stage discharge pipe connected to a low-stage muffler discharge hole through the first communication hole;

a high-stage compressing section provided near the low-stage compressing section within the compressor housing with one end of a high-stage suction pipe connected to a high-stage suction hole through the third communication hole and a high-stage muffler discharge hole communicating with inside of the compressor housing;

a motor for driving the low-stage compressing section and the high-stage compressing section;

a sealed cylindrical accumulator held at an outside part of the compressor housing;

a low-pressure connecting pipe for connecting a bottom communication hole of the accumulator and the other end of the low-stage suction pipe; and an intermediate connecting pipe for connecting the other end of the low-stage discharge pipe and the other end of the high-stage suction pipe, wherein the first, third communication holes are provided nearly in the same locations in the circumferential direction of the cylindrical compressor housing, the accumulator is held nearly in the same location in the circumferential direction as that of the second communication hole, and the second communication hole is provided in a different location in the circumferential direction from those of the first communication hole and the third communication hole for preventing interference between the low-pressure connecting pipe and the intermediate connecting pipe each formed in a two-dimensional arc shape.

2. The two-stage rotary compressor according to claim 1, wherein a low-stage vane of the low-stage compressing section and a high-stage vane of the high-stage compressing section are provided nearly in the same locations in the circumferential direction of the compressor housing, and the low-stage suction hole of the low-stage compressing section is provided in parallel close to the low-stage vane.

3. The two-stage rotary compressor according to claim 1, wherein the high-stage suction hole of the high-stage compressing section and the low-stage muffler discharge hole of the low-stage compressing section are provided nearly in the same locations in the circumferential direction of the compressor housing, and a low-stage cylinder is provided to shift in the circumferential direction so that the low-stage suction hole of the low-stage compressing section is located in a location in the circumferential direction different from those of the high-stage suction hole and the low-stage muffler discharge hole.

4. The two-stage rotary compressor according to claim 1, wherein the bottom communication hole of the accumulator is provided in a position apart from the compressor housing than the position of the center axis of the accumulator.

5. The two-stage rotary compressor according to claim 1, adapted to variable rotational speed.

* * * * *